United States Patent [19]

Lynham et al.

[11] Patent Number: 4,643,082

[45] Date of Patent: Feb. 17, 1987

[54] SPRAY BOOTHS

[75] Inventors: Ian H. Lynham, Gerrards Cross; Roy S. Windall, Sevenoaks, both of United Kingdom

[73] Assignee: Haden Drysys International, Ltd., United Kingdom

[21] Appl. No.: 642,195

[22] Filed: Aug. 20, 1984

[30] Foreign Application Priority Data

Feb. 17, 1984 [GB] United Kingdom ..... 8404199

[51] Int. Cl.[4] ..... B05C 15/00

[52] U.S. Cl. ..... 98/115.2; 55/241

[58] Field of Search ..... 55/240, 241; 98/115.2; 118/326, DIG. 7

[56] References Cited

U.S. PATENT DOCUMENTS

| | | | |
|---|---|---|---|
| 1,774,072 | 8/1930 | Whitmore | 98/115.2 |
| 2,171,574 | 9/1939 | Lambert et al. | 118/DIG. 7 X |
| 3,138,441 | 6/1964 | Krantz | 55/240 X |
| 4,285,270 | 8/1981 | Donahue | 98/115.2 |

FOREIGN PATENT DOCUMENTS

| | | | |
|---|---|---|---|
| 26359 | 4/1981 | European Pat. Off. | 98/115.2 |
| 2932392 | 2/1981 | Fed. Rep. of Germany | 118/326 |
| 2119280 | 11/1983 | United Kingdom | 98/115.2 |

*Primary Examiner*—Harold Joyce

*Attorney, Agent, or Firm*—Krass & Young

[57] ABSTRACT

The paint laden air extracted from a paint spray booth is flowed through a tubular member in intimate contact with a cleaning liquid such that the paint is washed from the air. To maintain the efficiency of the washing operation auxiliary air is supplied to the tubular member. The auxiliary air supply is controlled such that the total volume of paint laden air and auxiliary air flowing through the tubular member is maintained substantially constant.

12 Claims, 2 Drawing Figures

SPRAY BOOTHS

BACKGROUND TO THE INVENTION

The present invention relates to spray booths, and in particular to a method and apparatus for removing paint or other coating material from the air exhausted from a spray booth. It is customary to extract air from a paint spray booth and to wash it with a cleaning liquid, generally water, to remove the paint entrained in the exhaust air. Examples of washing systems for the exhaust air from paint spray booths are described in British Patent Specifications Nos. 1165022, 1399805, and 2007542B.

The washing systems described in the above identified patent specifications generally exhibit their best efficiency if a substantially constant volume of air flows therethrough. If the volume of air or the air speed varies, the characteristic performance of the washing systems varies. This can present a problem in that it may be required to vary the volume of air flowing through the paint spray. booth. Clearly if the air flow is so varied the efficiency of the washing systems can be impaired.

In some applications the volume of air flow through the booth must be reduced, and in other applications the volume of air flow can be substantially reduced without adversely affecting the painting operation. As the air supplied to the booth is generally conditioned to be at a predetermined temperature and humidity, any such reduction in the volumes used represents a substantial energy saving.

SUMMARY OF THE INVENTION

According to a first aspect of the present invention there is provided apparatus for removing paint from paint laden air comprising at least one washing means through which paint laden air is arranged to flow in intimate contact with a cleaning liquid, and auxiliary air supply means controllable to supply air to said washing means such that the volume of air flowing therethrough can be maintained substantially constant.

The invention also extends to apparatus for removing coating material from air laden with the coating material comprising means for inducing flow in said material laden air, washing means through which said material laden air flow is arranged to pass, and means for supplying cleaning liquid to said washing means, said washing means being arranged such that said material laden air flows therethrough in intimate contact with said cleaning liquid, the apparatus further comprising auxiliary air supply means for supplying air to said washing means, and means for controlling the volume of air supplied by said auxiliary air supply means whereby the total volume of material laden air and air supplied by said auxiliary air supply means flowing through said washing means can be maintained substantially constant.

In one embodiment, the auxiliary air supply means comprises means for recirculating air exhausted from said washing means back to said washing means.

Preferably, said washing means comprises a base plate which is arranged to extend substantially horizontally and has an upper surface and a lower surface, and a tubular member which passes through said base plate and is arranged to extend substantially vertically, and wherein said means for supplying cleaning liquid is arranged to supply cleaning liquid onto the upper surface of the base plate such that the cleaning liquid passes through said tubular member in intimate contact with said material laden air. The tubular member may project relative to the base plate such that a pond for the cleaning liquid is defined on the upper surface of the base plate.

In an embodiment the base plate defines the base of an air supply chamber having one or more air inlets for receiving material laden air and one or more auxiliary air inlets for receiving air from said auxiliary air supply means.

In an embodiment said chamber is defined between said base plate and a substantially horizontally extending sub-floor which has one or more air inlets therein.

In an embodiment, the or each air inlet in the sub-floor may comprise a tubular member extending through the sub-floor and extending substantially vertically. Preferably, each tubular member projects above the sub-floor and means are provided to supply cleaning liquid to said sub-floor such that a pool of cleaning liquid can be supported on the sub-floor.

The tubular members extending through the base plate and through the sub-floor may be circular, rectangular, or any other shape in cross section, and these members may be of any size.

The auxiliary air supply means preferably comprises adjustable dampers for controlling the volume of the auxiliary air supplied to said washing means.

The base plate is preferably spaced above a floor or plate and the tubular members extending through the base plate are arranged such that the air and water flowing through the members impacts the floor or plate.

The invention also extends to a spray booth comprising an enclosure in which material is sprayed, means for supplying air into said enclosure, means for extracting air laden with the sprayed material from said enclosure, and apparatus for removing the sprayed material from the material laden air extracted from said enclosure, said apparatus comprising washing means through which said material laden air flow is arranged to pass, and means for supplying cleaning liquid to said washing means, said washing means being arranged such that said material laden air flows therethrough in intimate contact with said cleaning liquid, the apparatus further comprising auxiliary air supply means for supplying air to said washing means, and means for controlling the volume of air supplied by said auxiliary air supply means whereby the total volume of material laden air and air supplied by said auxiliary air supply means flowing through said washing means can be maintained substantially constant.

Preferably, said air supplying means comprises an air supply fan, and a first control damper arranged to control the volume of air supplied by said air supply fan, and wherein said extracting means comprises an exhaust fan, and a second control damper arranged to control the volume of material laden air extracted by said exhaust fan. The exhaust fan is arranged to direct the extracted air to an outlet duct.

In one embodiment an auxiliary air inlet duct is provided in communication with the outlet duct and is arranged to supply air to said washing means. This auxiliary air inlet duct is preferably controlled by means of a damper. Alternatively, the auxiliary air inlet duct can be connected by way of a damper controlled duct to the outlet side of the supply fan. It would also be possible to connect the auxiliary air inlet duct to atmosphere either directly or by way of an auxiliary supply fan.

The invention also extends to a method for removing material from air laden with the material, the method comprising the steps of flowing the material laden air in one direction through a tubular member, simultaneously flowing a cleaning liquid through said tubular member in said one direction, and arranging that said material laden air and said cleaning liquid come into intimate contact such that said material is washed out of the air by said cleaning liquid, the method also comprising the steps of supplying auxiliary air to said tubular member, and controlling the volume of said auxiliary air such that the total volume of material laden air and auxiliary air flowing through said tubular member is maintained substantially constant.

BRIEF DESCRIPTION OF THE DRAWINGS

Embodiments of the present invention will hereinafter be described by way of example, with reference to the accompanying drawings, in which.

DESCRIPTION OF THE PREFERRED EMBODIMENTS

The paint spray booths illustrated are of the type through which automobile bodies or other articles to be painted are moved by way of conveyor means (not shown). The articles are painted either automatically or manually by spray painting means.

It is customary to extract air from the paint spray booth and to wash it with a cleaning liquid, generally water, in order to remove paint entrained in the exhaust air. A supply of air is fed to the spray booth through a distributor. Before it is fed to the booth, this supply air may be conditioned by means of air conditioning means (not shown)such that it has a predetermined temperature, humidity and cleanliness.

Figure 1:
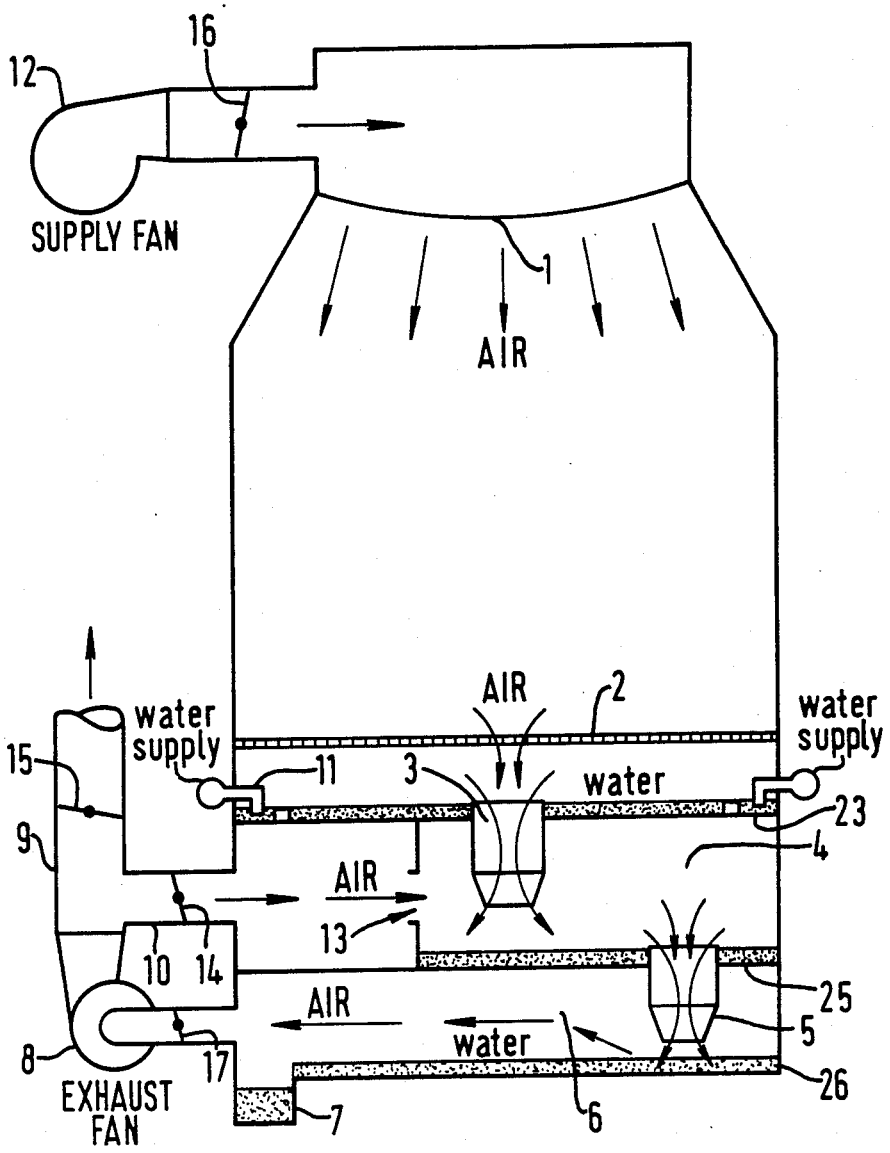
FIG. 1 shows a section through a paint spray booth illustrating a first embodiment of the invention.

In the embodiment illustrated in FIG. 1, the supply of air is fed to the spray booth through a distributor 1 by way of a supply fan 12. The air supplied to the booth passes over the articles to be spray painted where it becomes laden with paint. The paint laden air passes through floor grilles 2 and then through one or more substantially vertically extending exhaust tubes 3 provided in a substantially horizontal sub-floor 23 which extends across the booth beneath the grilles 2. A cleaning liquid, generally water which has been chemically treated to assist the adherence of paint particles to the water droplets, is fed to the sub-floor 23 by way of pumps (not shown) and pipes 11. The or each exhaust tube 3 is arranged to project above the level of the sub-floor 23 such that the sub-floor becomes flooded. The cleaning liquid is continuously supplied to the sub-floor and thus the liquid flows over the upper open end of each exhaust tube 3 and through the tube 3 in intimate contact with the air flowing therethrough. This washes paint from the air.

The or each exhaust tube 3, which may be circular, rectangular, or any other shape in cross section, communicates the upper side of the sub-floor 23 with a chamber 4. This chamber 4 has a substantially horizontal base plate 25 in which one or more substantially vertically extending exhaust tubes 5 are arranged. These exhaust tubes 5, which again may have any desired cross section, project above the level of the base plate 25 such that the cleaning liquid leaving the exhaust tubes 3 floods the base plate 25. The paint laden air is constrained to flow through the exhaust tubes 5 in intimate contact with the cleaning liquid for further washing of the air. The air-liquid mixture leaving the exhaust tubes 5 is arranged to impact a floor 26 such that the turbulence induced by this impact assists in the washing process. The floor 26 is arranged to define an air exhaust duct 6 through which the clean air is extracted by way of an exhaust fan 8. This clean air is then exhausted to atmosphere by way of an outlet duct 9.

The cleaning liquid in which the paint is now entrained passes into a flume 7 and thence to a reservoir (not shown). The paint can be removed from the cleaning liquid by any suitable means and then the liquid can be recirculated by way of the pumps (not shown) and the pipes 11 to the sub-floor 23. One apparatus for removing paint solids from a cleaning liquid is described in British Patent Specification No. 1540723.

As illustrated, all the cleaning liquid which has passed through the exhaust tubes 3 such that it is laden with paint subsequently passes through the exhaust tubes 5. If required, paint laden cleaning liquid can by pass the exhaust tubes 5 and flow directly into a flume. For example, a by pass tube (not shown) could communicate the flooded base plate 25 with the floor 26 such that a proportion of the paint laden cleaning liquid from the exhaust tubes 3 is fed directly to the flume 7 without passing through the exhaust tubes 5. If required, fresh cleaning liquid could also be fed to the base plate 25 for use in the exhaust tubes 5.

The effectiveness of the washing operation performed in the exhaust tubes 3 and 5 is dependent upon the speed and volume of air passing through the exhaust tubes, and for best results the air speed and volume flowing through each of the tubes should be kept substantially constant. However, it may be necessary to vary the volume of air flowing through the paint spray booth and this can present a problem as it would normally adversely affect the performance of the washing stages.

In the embodiment shown in FIG. 1, the efficiency of the washing operation effected in the exhaust tubes 5 is maintained by ensuring that the air flow therethrough is kept substantially constant.

It will be seen that the chamber 4 with which the exhaust tubes 5 communicate, is communicated with the outlet duct 9 by way of an air inlet orifice 13 and an auxiliar.y air inlet duct 10. The flow of air in this auxiliary air inlet duct 10 is controlled by an adjusting damper 14 arranged in the duct 10. Similarly, dampers 15 and 17 are provided to control the extraction of air from the booth and its exhaust to atmosphere, and a further damper 16 is provided to control the supply of air to the paint spray booth.

The air flow through the booth can be reduced by adjustment of one or more of the dampers 15, 16, and 17, and/or by adjusting the speeds of the supply or exhaust fans, or by other means. As the air supply through the booth is reduced, the damper 14 is adjusted such that exhaust air passes along the duct 10 and hence through the inlet orifice 13 into the chamber 4. The fans and dampers are so adjusted that the total volume of air passing through the exhaust tubes 5 remains substantially constant. Thus, the efficiency of the washing operation in the exhaust tubes 5 remains constant.

As the air flow through the booth is reduced, the volume of air flowing through the exhaust tubes 3 will be similarly reduced and hence the efficiency of the washing operation in these tubes could be reduced. The exhaust tubes 3 thus provide a preliminary, low efficiency washing stage whilst the exhaust tubes 5 provide a second, high efficiency washing stage.

The adjustment of the fans and dampers to provide the required air flows may be done manually or may be automatic. For example, a static pressure or velocity controller could be provided in the air supply or exhaust air ducts to initiate adjustment.

The overall efficiency of the washing system described for the paint booth is thus not impaired even though the air flow through the booth is reduced.

The arrangement illustrated in FIG. 1 also has the advantage that the noise levels in the booth are reduced as the high efficiency washing stage constituted by the exhaust tubes 5 is remote from the interior of the booth.

Figure 2:
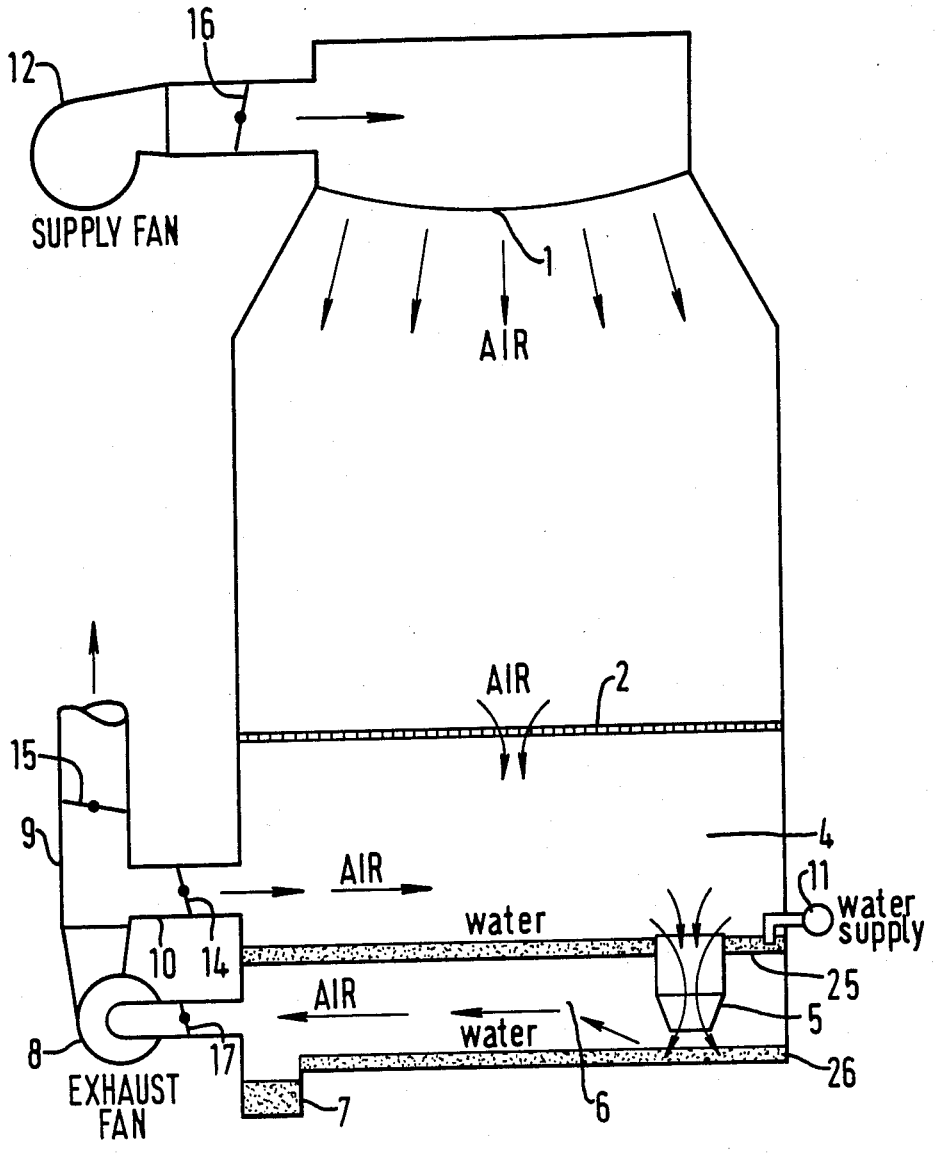
FIG. 2 shows a section through a further paint spray booth illustrating a second embodiment of the invention.

FIG. 2 shows a second embodiment of a paint spray booth embodying the present invention. In FIG. 2 features which are the same or similar to features of FIG. 1 have been given the same reference numerals.

It will be seen that the embodiment of FIG. 2 is very similar to that shown in FIG. 1 such that it will not be described in detail. The only difference between the embodiments is that the low efficiency washing stage of FIG. 1 defined by the exhaust tubes 3 has been omitted. The chamber 4 is thus defined by the floor 26 and the floor grilles 2. Thus, FIG. 1 shows a two-stage system whilst FIG. 2 shows a single stage system. Of course, the single stage system of FIG. 2 can be kept at a high efficiency because the air flow through the exhaust tubes 5 can be maintained substantially constant.

In both embodiments, the floor grilles 2 are provided when paint spraying operations are to be manually undertaken by operators who stand with the booth on these grilles. However, if the spray painting is to be done automatically by robots mounted on the side walls of the booth, these grilles 2 can be omitted.

Of course, if the floor grilles 2 are omitted in the embodiment of FIG. 2, there is no longer a chamber 4 physically delimited with respect to the interior of the paint spray booth. However, exhaust air can still be fed to the exhaust tubes 5 by way of the auxiliary air inlet duct 10 and can still be adJusted by way of the dampers such that the volume of air passing through the exhaust tubes is kept substantially constant.

In the embodiments illustrated the auxiliary air fed to the exhaust tubes 5, for example, by way of the chamber 4, is recirculated from the exhaust air. However, if required, a fan may be provided to supply air directly to the inlet 13 from atmosphere. Alternatively, a duct communicating the inlet of the exhaust tubes 5 with the supply fan 12 can be provided such that a proportion of the supply air is diverted to provide the auxiliary air supply for the exhaust tubes 5. Preferably, the inlet air would be diverted to the exhaust tubes 5 before it is passed through any air conditioning means provided such that the amount of air to be conditioned is reduced. Clearly, this reduces the energy requirements of the air conditioning means.

In the embodiments illustrated, the washing stages are each constituted by a number of discrete tubes. If required, these tubes could be replaced by a continuous slot having downwardly depending side walls.

We claim:

1. Spray coating apparatus comprising a chamber in which a spray coating operation is performed; means for inducing air flow through said coating chamber, washing means disposed under said chamber and through which said material laden air flow is required to pass in the course of exiting said chamber, and means for supplying cleaning liquid to said washing mean, said washing means being arranged such that said material laden air flows therethrough in intimate contact with said cleaning liquid, the apparatus further comprising auxiliary air supply means for supplying auxiliary air to the area immediately adjacent the inlet of said washing means so that said auxiliary air does not flow through the chamber on immediate route to said washing means, and means for controlling the volume of air supplied by said auxiliary air supply means whereby the total volume of air flowing through said washing means can be maintained substantially constant irrespective of changes in the volume of air flowing through said chamber.

2. Apparatus according to claim 1, wherein said auxiliary air supply means comprises exhaust means, and means for recirculating air exhausted from said washing means via said exhaust means back to said washing means.

3. Apparatus according to claim 1, wherein said washing means comprises a base plate which is arranged to extend substantially horizontally and has an upper surface and a lower surface, and a tubular member which passes through said base plate and is arranged to extend substantially vertically, and wherein said means for supplying cleaning liquid is arranged to supply cleaning liquid onto the upper surface of the base plate such that the cleaning liquid passes through said tubular member in intimate contact with said material laden air.

4. Apparatus according to claim 3, wherein said tubular member projects relative to the upper surface of the base plate to thereby define a pond for the cleaning liquid on said upper surface.

5. Apparatus according to claim 3, wherein an air supply chamber is provided, the base of said chamber being formed by said base plate such that said tubular member constitutes an air outlet for the chamber, and wherein said air supply chamber has at least one air inlet for receiving material laden air, and at least one auxiliary air inlet for receiving air from said auxiliary air supply means.

6. Apparatus according to claim 5, wherein the top of said air supply chamber is defined by a substantially horizontally extending sub-floor, one or more orifice means being provided in said sub-floor to form the air inlets for the material laden air.

7. Apparatus according to claim 6, wherein the or each orifice means comprises a tubular member arranged to pass through said sub-floor and to extend substantially vertically, and wherein said means to supply cleaning liquid is arranged to supply the cleaning liquid onto said sub-floor.

8. A spray booth comprising an enclosure in which material is sprayed, means for supplying primary air into said enclosure, means for extracting air laden with the sprayed material from said enclosure, and apparatus for removing the sprayed material from the material laden air extracted from said enclosure, said apparatus comprising washing means through which said material laden air flow is arranged to pass, and means for supplying cleaning liquid to said washing means, said washing means being arranged such that said material laden primary air flows therethrough in intimate contact with said cleaning liquid, the apparatus further comprising auxiliary air supply means for supplying secondary air to said washing means downstream of said enclosure but upstream of said washing means, and means for controlling the volume of air supplied by said auxiliary air supply means whereby the total volume of air flowing through said washing means can be maintained substantially constant irrespective of the volume of air flowing through said booth.

9. A spray booth according to claim 8, wherein said air supplying means comprises an air supply fan, and a first control damper arranged to control the volume of air supplied by said air supply fan, and wherein said extracting means comprises an exhaust fan, and a second control damper arranged to control the volume of material laden air extracted by said exahust fan.

10. A spray booth according to claim 8, further comprising an outlet duct into which air which has passed through said material removing apparatus is directed, an auxiliary air inlet duct communicating with said outlet duct, said auxiliary air inlet duct being arranged to supply air to said washing means, and control means for controlling the flow of air from said outlet duct to said auxiliary air inlet duct.

11. Method of removing paint overspray from the primary ventilation air of a paint spray booth of the type which comprises a painting chamber, and air exhaust outlet of cross-sectional area which is much smaller than the cross-sectional area of the spray booth, means for supplying primary air at an upstream location in the booth and causing it to flow through the booth and downstream of the booth through said exhaust outlet, and means for supplying said exhaust outlet with a cleaning liquid which mixes with the primary air for the purpose of washing paint particles therefrom, wherein the improvement comprises:

the step of supplying auxiliary air to the exhaust outlet downstream of the painting chamber so that such air is added to the primary air to maintain the volumetric flow rate of air through the exhaust outlet relatively constant irrespective of variations in the volumetric flow rate through the painting chamber.

12. The method of claim 11 wherein the step of supplying auxiliary air includes the substeps of exhausting the primary air downstream of the washer, and bleeding off a portion of the air being so exhausted and blending it back in with the primary air just upstream of the washer but downstream of the painting chamber.

* * * * *